United States Patent [19]

Petersson

[11] Patent Number: 4,641,878

[45] Date of Patent: Feb. 10, 1987

[54] TOY RAILWAY VEHICLE SET WITH CONSTRICTED OPENING RECESS IN HUB

[75] Inventor: Nils A. I. Petersson, Killeberg, Sweden

[73] Assignee: 501 Brio AB, Osby, Sweden

[21] Appl. No.: 777,254

[22] Filed: Sep. 18, 1985

[30] Foreign Application Priority Data

Sep. 27, 1984 [SE] Sweden ..... 8404834

[51] Int. Cl.[4] ..... B60B 7/04; B60B 3/14; B60B 27/06; B60B 37/10

[52] U.S. Cl. ..... 295/49; 446/469; 301/112

[58] Field of Search ..... 301/126, 112, 122, 109, 301/110; 295/44, 49; 446/465, 466, 469

[56] References Cited

U.S. PATENT DOCUMENTS

| | | | |
|---|---|---|---|
| 2,987,851 | 6/1961 | Bonanno | 105/157 T |
| 3,835,583 | 9/1974 | Manning | 446/465 |
| 4,148,152 | 4/1979 | Barlow et al. | 446/410 |
| 4,522,607 | 6/1985 | Kilroy et al. | 446/469 X |

FOREIGN PATENT DOCUMENTS

| | | | |
|---|---|---|---|
| 0692404 | 5/1940 | Fed. Rep. of Germany | 446/465 |
| 2526305 | 12/1976 | Fed. Rep. of Germany . | |
| 138095 | 1/1983 | Fed. Rep. of Germany . | |
| 2235583 | 1/1975 | France . | |

*Primary Examiner*—Robert B. Reeves
*Assistant Examiner*—Scott H. Werny
*Attorney, Agent, or Firm*—Laurence R. Brown

[57] ABSTRACT

The present disclosure is directed to a wheel set for toy rail vehicles having wheels with rims extending radially from hubs which are mounted on a smooth axle passed through a hole in the chassis of the vehicle. A spring disc with a cover is fitted on the axle end and clutched by the wheel hub provided with a constricted opening recess, thereby retaining the wheels on the axle.

1 Claim, 3 Drawing Figures

TOY RAILWAY VEHICLE SET WITH CONSTRICTED OPENING RECESS IN HUB

BACKGROUND OF THE INVENTION

This invention relates to a wheel set for toy rail vehicles comprising two rim provided hubs mounted on a shaft journalled in a vehicle chassis.

Toy rail vehicles of the type adapted to be used by small children and in which at least the wheel rims and often also the greater part of the vehicle chassis are made of wood or plastic materials should be provided with wheel sets according to certain specifications regarding reliability, function, manufacture and assembly.

Wheel sets of the type referred to above have hitherto only been used for vehicles in which the rim parts have been made of metal and in vehicles adapted to be used as model trains—toys not normally used by smaller children.

Toy rail vehicles having rims of wood or plastic materials have hitherto been provided with hubs journalled on shafts consisting for four nails in each chassis. The nailing of the wheels should be performed with great care. It should not be possible that a wheel may come off and be swallowed by a child. Therefore, in each set of wheels the nailing must be performed with relative displacement in the longitudinal direction of the vehicle. The nails are of such length that they will overlap each other in the transversal direction of the vehicle. If nails from opposite sides of the vehicle meet each other, they could easily become loose. Such nailing often results in poor maneuverability and a less attractive appearance.

SUMMARY OF THE INVENTION

The object of the present invention is to be able to use wheels having rims of wood or plastic materials in a wheel set for toy rail vehicles comprising two rim provided hubs mounted on a shaft journalled in a vehicle chassis, and according to the invention obtained thereby, each hub comprises two axially connected parts of which the outer one has been rigidly connected to the shaft.

BRIEF DESCRIPTION OF THE DRAWINGS

The invention will be described below, reference being made to the drawing in which.

DESCRIPTION OF THE PREFERRED EMBODIMENT

Figure 1:
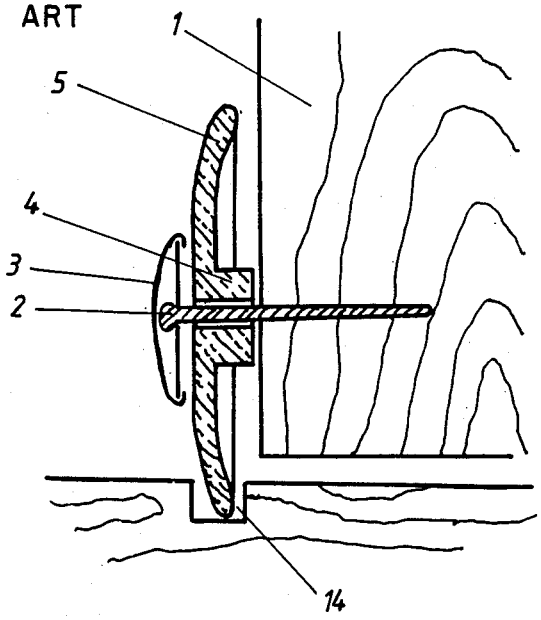
FIG.1 PRIOR ART
FIG. 1 shows a cross section of a part of a chassis provided with wheels mounted in conventional manner.

In FIG. 1 the reference numeral 1 designates a chassis of wood in which a nail 2 is fastened. The nail 2 is so-called "furniture nail" having a nail head 3 of chromed steel plate. The nail 2 acts as a journalling shaft for a wheel 4,5 consisting of a hub part 4 and a rim part 5.

The nails 2 should have a length of 15–20 mm in order to secure a reliable fastening in the chassis 1. If said chassis is only 20 mm wide the four wheels of the chassis must all be displaced in the longitudinal direction of the vehicle in order to prevent nails from opposite sides from meeting each other and thus decreasing their ability to resist attempts to be removed.

The bearing length of the hub is only a few millimeters offering a poor guidance of the wheel 4,5.

Figure 2:
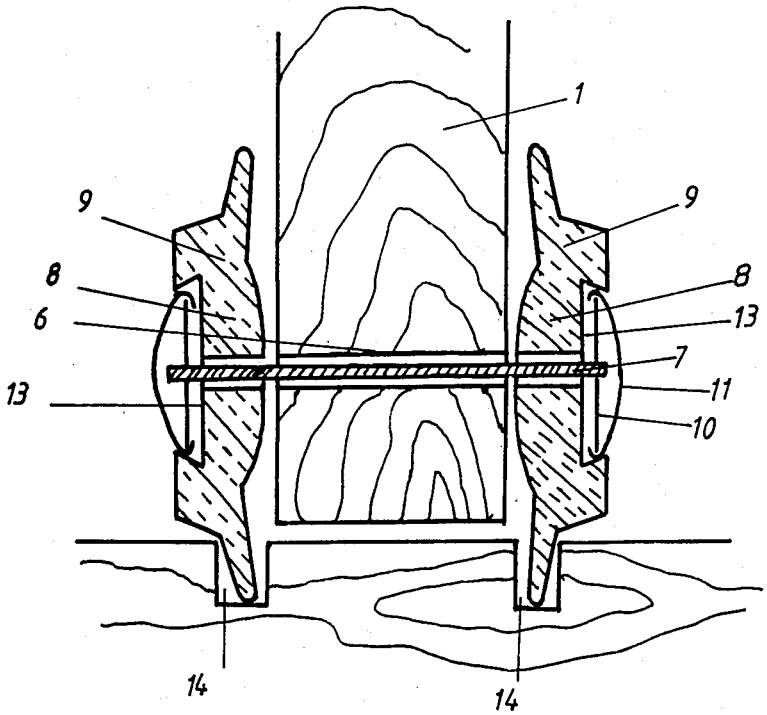
FIG. 2 shows a cross section of a chassis provided with a wheel set according to the present invention.

FIG. 2 shows a wheel set according to the invention. Again the chassis of the vehicle or wheel support members has been designated by the reference numeral 1 and has been provided with a bore 6 forming a bearing for a smooth steel axle 7 having a diameter of about 2 mm.

Figure 3:
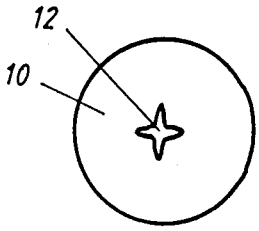
FIG. 3 shows a spring disc of the type used in the wheel set according to FIG. 2.

The steel axle 7 is provided with two support wheels 8,9 having hub parts 8 and rim parts 9. The connection between the hub parts 8 and the axle 7 is not critical. The hub parts 8 could be rather tightly mounted—however, they should be axially displaceable on the axle 7 in the axial direction if exposed to a reasonable force. However, they could also be mounted so as to be very easily displaceable on the axle 7 in the axial direction as well as in the directions of rotation. At the extreme ends of the shaft a spring disc 10 with a cover 11 has been rigidly mounted. The spring disc 10 has been shown in FIG. 3 and consists of a circular steel disc provided with a central, star-shaped hole 12. When the disc 10 with the cover 11 is fitted on the end of the axle 7 the limiting edges of the hole 12 will be slightly deformed so that the spring disc 10 may be displaced inwardly on the axle 7 with a reasonable force—about 20N—so that in the outward direction it will offer a resistance force of about 400N—a force substantially exceeding the force a child (even with the help of conventional tools) is able to provide.

The hub part 8 is provided with a recess 13 of rotation-symmetrical shape. Said recess has an undercut wall or dove tail shape in cross section view and is thus able to retain the spring disc 10 and cover 11 after having been elastically deformed.

The connection between the spring disc 10 and the cover 11 at one side and the support wheel 8,9 at the other side is not critical. Most important is that the axial play is limited. It could be zero—so that a clutch connection in the direction of rotation is obtained—but alternatively axial and radial play may exist, allowing the support wheel 8,9 to rotate relative to the spring disc 10 and cover 11. The latter alternative is of course only possible if there is a play between the hub 8 and the axle 7. The rails or guide tracts for the vehicle have been designated by 14 in FIG. 1 and in FIG. 2 and they are formed by grooves in wooden plates.

By a suitable choice of the tolerances for the elements in the wheel set—the axle 7, the hole for the axle 7 in the hub 8, the limiting walls for the recess 13 and the diameter of the cover 11—it is possible to obtain either an intentional clutch connection in the directions of rotation between the two wheels of a wheel set (which will cause improved running on a straight path) or a possibility of individual rotation of each wheel (causing improved running through curves). In both cases an optimum of wheel guiding will be obtained.

I claim:

1. A wheel set for toy rail vehicles having downwardly directed wheel support members having a bore therethrough, a pair of support wheels, a hub on said wheel and rim means extending radially from said hubs and being engageable with a guide tract for the wheel, each hub having a bore therethrough, an axle for said support wheels and being of a diameter less than the bore in said support members, a spring disc anchor means for each wheel having a struck out central star portion the diameter of which is less than the diameter of said axle to form a lock with said axle to prohibit axial withdrawal of the support wheels from said axle once the spring disc anchor means has been set on each wheel on opposite sides of said wheel support means, in each said hub an undercut wall larger at its inner end and tapered to a smaller opening at its outer end defining a constricted opening recess for housing and retaining said spring disc anchor means and a cover locked within the wheel hub to retain the wheel axially secured to the axle and the cover all of which are substantially secured against axial displacement from within said constricted opening recess.

* * * * *